US011680385B1

(12) United States Patent
Brownson et al.

(10) Patent No.: US 11,680,385 B1
(45) Date of Patent: Jun. 20, 2023

(54) RIDE CONTROL VALVE

(71) Applicant: Hydac Technology Corporation, Bethlehem, PA (US)

(72) Inventors: Daniel Frank Brownson, Westfield Center, OH (US); Scott Thomas Rhamey, Loudonville, OH (US); Aaron Shetler, Marshallville, OH (US)

(73) Assignee: HYDAC TECHNOLOGY CORPORATION, Bethlehem, PA (US)

( * ) Notice: Subject to any disclaimer, the term of this patent is extended or adjusted under 35 U.S.C. 154(b) by 0 days.

(21) Appl. No.: 17/672,970

(22) Filed: Feb. 16, 2022

(51) Int. Cl.

| | |
|---|---|
| ***E02F 9/22*** | (2006.01) |
| ***F15B 1/02*** | (2006.01) |
| ***F15B 21/00*** | (2006.01) |

(52) U.S. Cl.
CPC ..... *E02F 9/2207* (2013.01); *E02F 9/2217* (2013.01); *E02F 9/2285* (2013.01); *F15B 1/021* (2013.01); *F15B 21/008* (2013.01)

(58) Field of Classification Search
CPC ..... F15B 1/021; F15B 21/008; E02F 9/2207
See application file for complete search history.

(56) References Cited

U.S. PATENT DOCUMENTS

| | | | | |
|---|---|---|---|---|
| 5,733,095 | A * | 3/1998 | Palmer | E02F 9/2217 60/413 |
| 5,992,146 | A * | 11/1999 | Hausman | E02F 9/2292 60/494 |
| 6,321,534 | B1 * | 11/2001 | A'Hearn | E02F 9/2207 60/413 |
| 6,634,653 | B2 * | 10/2003 | Chatterjea | E02F 9/2217 280/5.5 |
| 10,246,854 | B2 * | 4/2019 | Greer | E02F 9/2217 |
| 2006/0101815 | A1 | 5/2006 | Kobayashi et al. | |
| 2022/0025914 | A1 * | 1/2022 | Slattery | E02F 9/2207 |

FOREIGN PATENT DOCUMENTS

| | | |
|---|---|---|
| EP | 3 162 965 | 1/2021 |

* cited by examiner

*Primary Examiner* — Thomas E Lazo
(74) *Attorney, Agent, or Firm* — Wenderoth, Lind & Ponack, L.L.P.

(57) ABSTRACT

A ride control valve includes a valve housing (30) having a main spool (32) longitudinally displaceably arranged in the valve housing, a balance spool (34), and fluid passage points for a pressure supply (P), a tank return line (T), an accumulator (14) and a boom cylinder unit (10). The balance spool (34) continuously balances the pressure between the fluid ports of the accumulator (14) and the boom cylinder unit (10). The main spool (32) is controlled by the operator and initially interconnects these fluid ports of the accumulator (14) and the boom cylinder unit (10), starting from a closed fluid connection, via a restricted fluid connection, to a fully opened fluid connection, or disconnects them from each other in reverse sequence.

16 Claims, 4 Drawing Sheets

RIDE CONTROL VALVE

FIELD OF THE INVENTION

A ride control valve for hydraulic system development and equipment reduces vibrations during movement of the equipment.

BACKGROUND OF THE INVENTION

Heavy earthmoving equipment typically uses hydraulic power to move a bucket on the front end of the equipment for digging, scooping and moving heavy loads. These pieces of equipment use two lifting cylinders called boom cylinders, in conjunction constituting a boom cylinder unit. A main control valve pressurizes the base end of the cylinders to raise the heavy load off the ground. The hydraulic oil in the base end of the cylinders creates an incompressible volume. When the equipment is driven at faster speeds over rough terrain, the induced forces on the heavy load transferred into the boom cylinders cause extreme shaking of the machine and a very uncomfortable ride for the operator of such mobile machines, like wheel loaders. This situation has then forced equipment manufacturers to find a solution to allow for the boom to have some elasticity when the machine is operated in a transportation or drive mode. The ride control valve accomplishes this by connecting the base end of the cylinder(s) to an accumulator allowing the boom to move slightly up and down, which in turn significantly reduces vibrations and increases the operator comfort.

The difficulty in developing systems having accumulators that can be coupled and uncoupled to the base end of the boom cylinders is that the pressures between the base end of the cylinder and the pressure in the accumulator have to be balanced before the ride control valve is fully opened. If the pressure in the base cylinder is higher than the accumulator pressure, the load will drop in a manner unpredictable for the operator when the ride control system is engaged. If the pressure in the hydraulic accumulator is higher than in the base end of the cylinder, the load will raise in an unpredictable manner.

To solve these problems, equipment manufacturers have basically taken two different approaches. The first approach is to simply accept that the load could drop and jump unaccountably when the ride control system is engaged. This first approach is the cheapest way to handle this problem, but for higher-end customers it renders their machines handling unpredictable and difficult to use. The other approach has been to use sophisticated electronics to ensure that the pressure of the base end of the cylinder unit and the accumulator match before connecting the two pressure volumes. This other system usually requires a controller and a couple of pressure transducers to be properly implemented, leading to additional cost the original equipment manufacturer (OEM) is typically not willing to pay.

For example, U.S. Patent Publication No. 2006/0101815 A1 discloses a hydraulic ride control system for an agricultural or construction vehicle, such as a wheel loader, which is provided with boom cylinders, an actuator control valve for controlling a pressure in bottom pressure chambers of the boom cylinders, an accumulator connected to the boom pressure chambers of the boom cylinders via a connection line, an opening control valve having a pilot chamber to selectively communicate via or close the connection line depending on a pressure in the pilot chamber, and a selector unit for selectively pressurizing or de-pressurizing the pilot chamber. The selector unit comprises a controller for variably controlling an opening of the opening control valve. This system will lead to a solution wherein the control device actuates the opening control valve to provide an optimum opening cross-section as a function of a change in the weight of the front section of the wheel loader. Vibrations that occur when driving with a load can then be suppressed irrespective of a change in the weight of the front section.

EP 3 162 965 B1 refers to a hydraulic system for a mobile machine having a lift arm attached to a bucket and a transmission. This hydraulic system includes a hydraulic actuator configured to move the lift arm and bucket. The hydraulic system further includes an accumulator configured to store pressurized fluid and an accumulator valve configured to control the fluid flow between the accumulator and the hydraulic actuator as a ride control valve, for a ride control mode of operation configured to cushion the motion of the bucket. The hydraulic system also includes a lift arm sensor assigned to the mobile machine and configured to generate an angle signal indicative of an angle of the lift arm and a speed sensor assigned to the mobile machine and configured to generate a speed signal indicative of the speed of the mobile machine, such as a wheel loader. The controller is also configured to selectively activate and deactivate the ride control mode of operation based on the speed of the mobile machine and the angle of the lift arm when the gear setting of the transmission is below a minimum gear setpoint.

SUMMARY OF THE INVENTION

Based on this state of the art, the invention addresses the problem of improving the valve devices described above.

A ride control valve according to the invention in its entirety solves this problem.

The ride control device according to the invention comprises at least of a valve housing having a main spool longitudinally displaceably arranged therein and a balance spool and having fluid passage points for a pressure supply, a tank return line, an accumulator and a boom cylinder unit. The balance spool continuously balances the pressure between the fluid ports of the accumulator and the boom cylinder unit. The main spool, controlled by the operator, initially interconnects these fluid ports of the accumulator and the boom cylinder unit, starting from a closed fluid connection, via a restricted fluid connection, to a fully opened fluid connection, or disconnects them from each other in reverse sequence.

These features make for a soft shift of the main ride control spool. The basic idea is to allow the main spool to slowly shift to the open position in the first part of the spool stroke, and then to quickly shift to the completely open position once the spool has reached a certain position. This movement of the main spool allows the pressure to slowly balance between the base end of the cylinder unit and the accumulator via notches in the spool for a certain period of time, and then to fully open to allow for maximum flow between the base end(s) of the cylinder(s) and the accumulator. In case the ride control valve is deactivated, the procedure will be reversed from the fully open position via positions with fluid restriction to the completely closed position, disconnecting the fluid transfer from the hydraulic accumulator to the boom cylinder unit and vice versa.

In a preferred embodiment of the ride control valve according to the invention, provision is made to accommodate the balance spool in a spool chamber in the valve housing, to hold the balance spool in a spring-centered manner in its initial position, to subject the balance spool in all of its travel positions at opposite ends on the one hand to the accumulator pressure of the accumulator and on the other hand to an operating pressure, in particular the piston-end pressure, of the boom cylinder unit, and for the balance spool to achieve a continuous pressure balance at a higher operating pressure than the accumulator pressure to establish a fluid-conveying connection between the fluid ports of the pressure supply and the accumulator by moving in one direction, and a higher accumulator pressure than the operating pressure to establish a fluid-conveying connection between the fluid ports for the accumulator and the tank return line by moving in an opposite direction.

In this way, the balance spool essentially has the fluid control task of maintaining the pressure of the accumulator at the same pressure or pressure level as the operating pressure existing in the boom cylinder unit, involving one or more interconnected boom cylinders.

In a further preferred embodiment of the ride control valve according to the invention, provision is made for the main spool to be mounted in a spool chamber in the valve housing, to be held in its initial position in a partially spring-centered manner, and to be moved by at least one pilot valve by the operator against the spring force of the partial spring centering by establishing a fully open fluid connection between the fluid ports of the accumulator and the boom cylinder unit.

Accordingly, the main spool has the task of providing full damping to obtain the maximum possible driving comfort during operation of the mobile machine under different load conditions by establishing a complete fluid connection between the hydraulic accumulator and the boom cylinder unit and its boom cylinders. This full damping state is established successively, and thus, without jolting by the main spool establishing the fluid connection between the accumulator and the boom cylinder unit in an initially restricted manner up to the fully open position.

Preferably, the cross-section of the main spool is reduced in the area of the fluid port having the boom cylinder unit in the direction of the fluid port having the accumulator, forming a restriction, to maintain the restricted fluid connection. In a further preferred embodiment of the valve device according to the invention, provision is made for the main spool to have a further restriction on its outer circumference, which passes the pilot pressure of the pilot valve into a control chamber in the further spool chamber, for the pilot pressure to visibly move the main spool in the direction of the fully opened fluid connection, when the spring force exceeds that of the partial spring centering, and synchronously to interrupt the fluid connection via the further throttling point. In this way, an independent pilot valve of the valve device can be used to trigger the actuation in real time and, in that way, generate or block complete damping by continuously moving the main spool into its individual actuation positions synchronously with the pilot pressure. The pilot pressure can be preset by the operator. Preferably, the further restriction is formed by a transverse drilled hole in the main spool, which drilled hole transitions into a longitudinal drilled hole that opens into the control chamber, which is advantageous in terms of fluid routing and requires little installation space in the valve housing.

As an alternative to this solution, it can be provided that the main spool has a longitudinal channel that, on its one end next to the control chamber, opens out into a further control chamber having the partial spring centering. At its other free end region, the longitudinal channel opens out into a further third restriction, after which, with increasing overlap, a subsequent transverse connection having a larger cross-sectional area in comparison opens into the tank return line. In this way, the control pressure required for a motion of the main spool from a fully closed position through a restricted to a fully open fluid connection between the accumulator and the boom cylinder unit can be relieved on the tank return end and in that way to control the motion of the main spool.

In the ride control valve according to the invention, it is particularly space-saving to make provision to screw or insert the respective pilot valve into the valve housing having the main spool and the balance spool. The pilot valve can preferably be controlled by an actuating solenoid, the energizing of which is in turn operator-controlled. Preferably, provision is also made for the individual pilot valve to have its own pressure fluid supply. The pilot control pressure of the individual pilot valve is lower than the supply pressure at the fluid port of the valve housing having the actual pressure supply.

In a particularly preferred embodiment, the ride control valve is used in a ride control valve comprising at least one hydraulic boom cylinder unit and one hydraulic accumulator device. The ride control valve has a main spool and a balance spool in a joint valve housing. A pilot valve can be used to at least partially co-control the two spools, which is likewise at least partially accommodated in this valve housing.

Other objects, advantages and salient features of the present invention will become apparent from the following detailed description, which, taken in conjunction with the drawings, discloses preferred embodiments of the present invention.

BRIEF DESCRIPTION OF THE DRAWINGS

Referring to the drawings that form a part of this disclosure and that are general and not to scale.

DETAILED DESCRIPTION OF THE INVENTION

Figure 1:
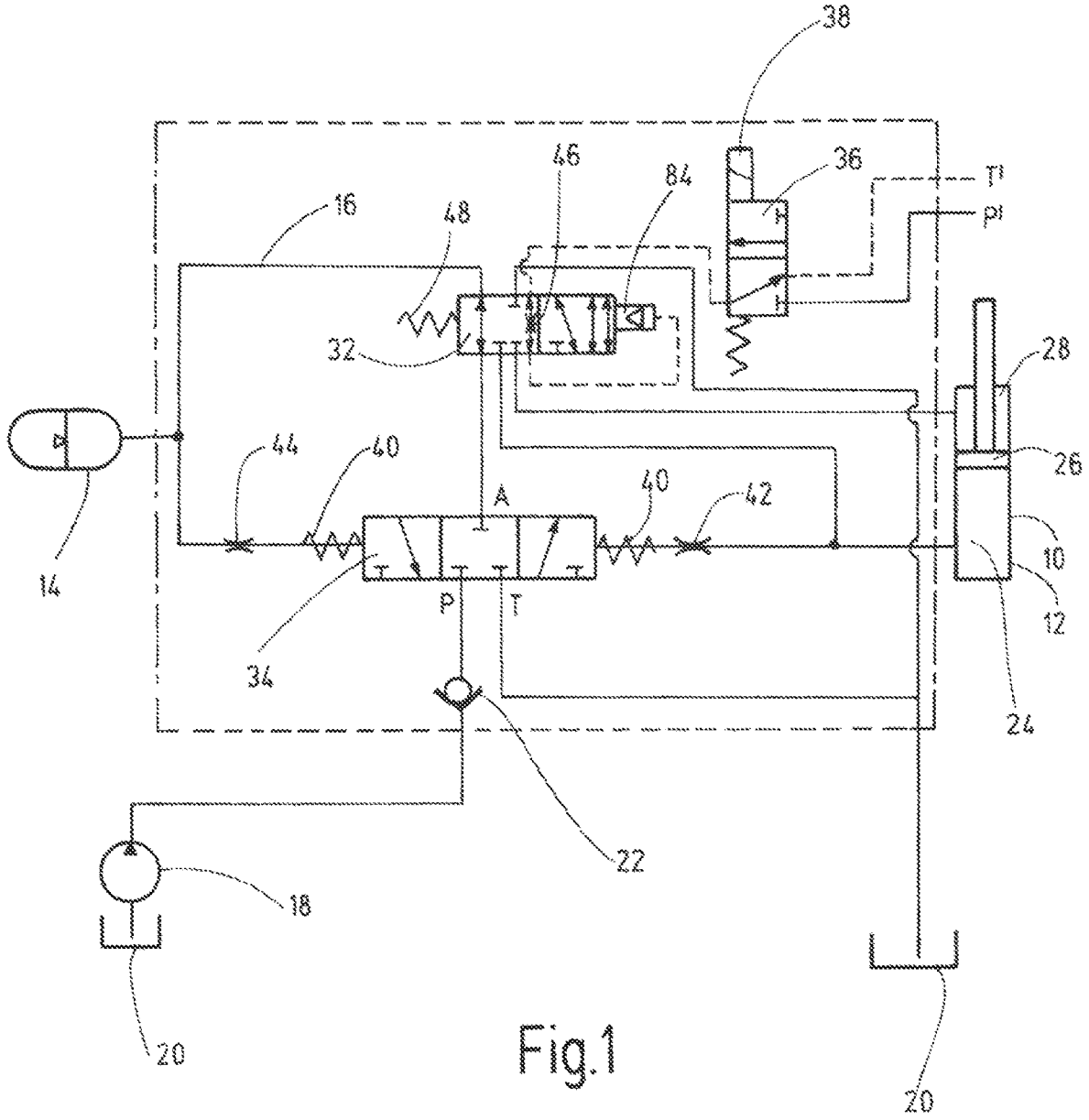
FIG. 1 is a schematic hydraulic circuit diagram of the basic structure of a ride control valve according to a first exemplary embodiment of the invention.

The hydraulic circuit diagram according to FIG. 1 shows a hydraulic boom cylinder unit 10 having a single piston cylinder 12. Instead of a single boom cylinder 12. Several such boom cylinders, in particular two boom cylinders, can be interconnected to form the cylinder unit 10, for instance to move the loading bucket of a mobile machine, for instance in the form of a wheel loader (not shown). Depending on the load in the loading bucket, different load conditions occur, in particular in the front wheel area of the wheel loader. To cushion the boom cylinder unit 10, in particular when the mobile machine is driven or to dampen its possible travel motions, a hydraulic accumulator 14 is provided, which can be made up of one or more hydraulic accumulators of conventional design, for instance in the form of piston accumulators, bladder accumulators, diaphragm accumulators, etc. The hydraulic accumulator 14 is connected to a hydraulic fluid circuit 16 as shown in FIG. 1. The fluid of the hydraulic fluid circuit 16, typically a hydraulic fluid, can be rest inside the accumulator 14 against a gas supply thereof in the usual manner and typically subject to a preload.

The hydraulic fluid circuit 16 is supplied with fluid of predeterminable pressure and quantity by a pressure supply device 18, typically in the form of a hydraulic pump, from a supply tank 20. A check valve 22, which closes in the direction of the pressure supply device 18 and opens in the opposite direction is provided to prevent any unintentional backflow of fluid in the direction of the hydraulic pump 18. Furthermore, as part of a closed loop system, excess fluid from the fluid circuit 16 is recirculated to the supply tank 20 for re-withdrawal using the hydraulic pump 18. The boom cylinder 12 shown in FIG. 1 is designed as a differential cylinder and has a piston or base end 24, which is separated from a rod chamber 28 by a longitudinally movable piston-rod-unit 26. Both the piston end 24 and the rod end 28 are enclosed by a cylinder housing in the usual manner. Both the piston end 24 and the rod end 28 are connected to the fluid circuit 16 in a fluid-conveying manner.

The valve device or ride control valve for controlling the transfer of fluid between the boom cylinder unit 10 and the accumulator 14 is installed between the two fluid components, as shown in FIG. 1. For an actuation, the valve device has a main spool 32 longitudinally displaceably arranged in a valve housing 30 (FIG. 2), in addition to a balance spool 34 and a pilot valve 36, which can be actuated by an operator of the mobile machine and which can be actuated by an actuating solenoid device 38.

The balance spool 34 is spring-centered between two compression springs 40 of the same design and held in its initial position shown in FIG. 1, in which the fluid ports for the pressure supply P and for the tank return line T are separated from each other and from an outlet A leading in the direction of the accumulator 14. Furthermore, the balance spool 34 interacts with two orifices 42 and 44 in an assigned hydraulic control line, which orifices are preferably of the same design. If the fluid pressure increases in the boom cylinder unit 10 on the piston end or base end 24, for instance because the piston rod unit 26 moves into the housing of the boom cylinder due to force, the balance spool 34 is moved to the left into its right actuating position, as viewed in the direction of FIG. 1, provided the accumulator pressure of the accumulator 14 is lower than the spool pressure on the piston end or base end 24. In this case, when the hydraulic pump 18 is switched on, fluid is supplied to the outlet end A via the pressure supply port P. When the main spool 32 is in the switching position or actuating position shown in FIG. 1, fluid at a presettable pressure level enters the accumulator 14 until pressure balance is again achieved at the two opposite ends of the balance spool 34, with the result that the balance spool 34 returns to its initial or blocking position shown in FIG. 1.

If the fluid pressure on the end of the accumulator 14 is greater than on the bottom end 24 of the boom cylinder unit 10, the balance spool 34 moves to the right into its left switching or actuating position, in which the accumulator 14 discharges fluid via port A in the direction of the tank return line T, and thus, discharges to the supply tank 20 without pressure. This process continues until a pressure equilibrium is again achieved at the opposite control ends of the equalizing spool 34. The prerequisite for the pressure adjustment is again the main spool 32 moving to its switching position shown in FIG. 1. The main task of the balance spool 34 is then to keep the relevant fluid pressures both on the end of the boom cylinder unit 10 and on the end of the accumulator 14 constantly at the same level during normal working mode of the mobile machine, for instance in the context of picking up or setting down a load as part of the bucket operation, to enable jolt-free and low-vibration switching on of the damping device as soon as the mobile machine moves in drive mode from a location A to a location B, irrespective of the load situation at the bucket and consequently at the boom cylinder unit 10. Insofar as, as in this exemplary embodiment, the boom cylinder unit 10 is directly assigned to the actuation of the excavator or loading bucket, this is not mandatory and the boom cylinder unit 10 can also be used to support other load-dependent components that are present in the area of a mobile machine.

If the pilot valve 36 is actuated by the actuating solenoid device 38, it moves to its upper switching position as viewed in the direction of FIG. 1. An independent pressure supply device (not shown) is used to apply a fluid pressure P', which is reduced in comparison to the pressure P of the hydraulic pump 18. Fluid pressure P' is supplied to the right-hand hydraulic control end of the main spool 32 after passing through a restriction or further orifice 46 in the main spool 32. As the fluid pressure increases, the main spool 32 is moved to the left into its right-hand actuating or travel position against the action of a further compression spring 48. Fluid then increasingly reaches the right-hand control end of the spool 32 via the restriction 46 and its increasing opening cross-section. In this way, a fluid connection from the accumulator 14 to the piston end or base end 24 of the boom cylinder unit 10 is gradually established, whereas the rod chamber 28 is de-pressurized in the direction of the supply tank 20 and, if necessary, excess fluid reaches the fluid supply tank 20 via the open-centered main spool 32. While initially this fluid connection between the accumulator 14 and the boom cylinder unit 10 is established in a restricted manner, ultimately the cross-section of the main spool 32 opens fully, and the boom cylinder unit 10 can be supported as a whole by the accumulator 14 in damping mode when the mobile machine is driven. This arrangement is extremely comfortable for the operator of such a machine, because a low-vibration operation is achieved without jolting. Any motion shocks during drive operation are safely absorbed by the accumulator 14 by the main spool 32 with the valve device in the fully open position.

When the driving operation is finished and the working mode using the loading bucket is resumed, the pilot valve 36 is returned to its unactuated position as shown in FIG. 1. The consequence is that the hydraulic control pressure at the main spool 32 is depressurized via the tank return line T'. The partial spring centering by the further pressure spring 48 of the main spool 32 is used to move it to its position shown in FIG. 1, which is equivalent to switching off the damping device by the accumulator 14. The balancing processes described above between the operating pressures of the accumulator 14 and the boom cylinder unit 10 again occur via the balance spool 34.

Below, the valve device according to the invention as used in the ride control device according to FIG. 1 is described in more detail with reference to FIG. 2. Thus, the valve device according to the embodiment shown in FIG. 2 has a onepiece valve housing 30. However, it is understood that a valve housing to this effect may also be of multi-part design. Fluid ports are provided for the pressure supply P and the tank return line T on the bottom end of the valve housing 30. The longitudinally movable balance spool 34 is arranged superjacent thereof, which is shown spring-centered via the two compression springs 40 in its locking central or initial position. On both opposite ends of the balance spool 34, two longitudinal drilled holes of equal length are made, each having the orifice 42 or 44 on its free end face. At their ends facing each other, the two longitudinal channels open into one transverse channel 50 each. One of the transverse channels 50 opens into a fluid chamber 52, in which the fluid connection pressurizes the fluid at the piston end or base end 24 of the boom cylinder unit 10. The other transverse channel 50 opens into another fluid chamber 54, which leads to a fluid port S to which the accumulator 14 is connected.

Furthermore, longitudinal grooves are introduced in the outer circumference of the balance spool 34. The central longitudinal groove marked "A" establishes a fluid connection between the pressure supply port P and the accumulator port S via the blind channel 56 when the balance spool 34 is displaced to the far left as viewed in the direction of FIG. 2. In the opposite direction of displacement of the balance spool 34 to the right, in the shown position of the main spool 32, the fluid pressure from the end of the accumulator 14 reaches the tank return end T via the accumulator connection S and the central, vertically extending blind line 58 and the further fluid connection 60 in the manner of a blind line. For a displacement motion of the balance spool 34 to the left, the pressure in the control chamber 62 is higher than on the opposite end having the further control chamber 64. The control chamber 62 is pressurized via the fluid chamber 52, the transverse channel 50 and the restriction 42. If the pressure in the further control chamber 64 is higher than the pressure in control chamber 62, the balance spool 34 is moved to the right. The pressure in the further control chamber 64 builds up from the end of the accumulator connection S via the assigned transverse channel 50 and longitudinal drilled hole with adjoining further restriction 44. When the balance spool 34 is moved to the left, the pressure at the accumulator port S is increased by connecting this accumulator port S to the pressure supply port P. When the balance spool 34 moves to the right, on the other hand, which happens when the pressure at the accumulator port S is greater than the pressure of the boom cylinder unit 10 in the fluid chamber 52, a fluid connection is established between the accumulator port S and the tank return port T until once again, there is a pressure equilibrium between the accumulator 14 and the boom cylinder unit 10, resulting in the balance spool 34 resuming its spring-centered initial position shown in FIG. 2.

Figure 2:
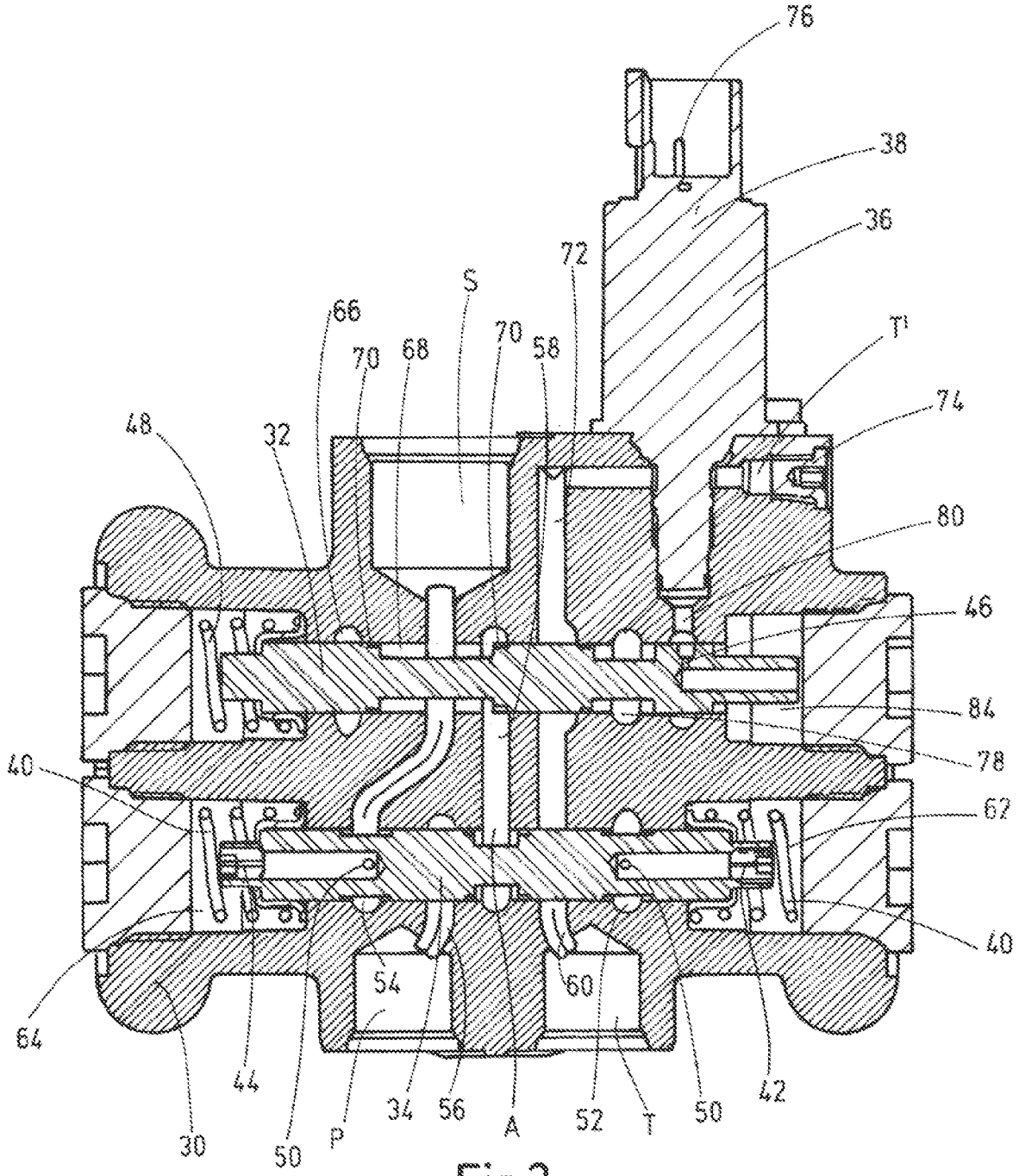
FIG. 2 is a side view in section of the main components of the ride control valve shown in the schematic diagram in FIG. 1.

Viewed in the direction of FIG. 2, the main spool 32 is arranged above the balance spool 34. Both spools 32, 34 are guided longitudinally movable in parallel to each other in the valve housing 30. The various embodiments and possible travel positions of the main spool 32 are shown in more detail in FIGS. 3-6, i.e. further reference will be made to these below. The left end of the main spool 32 rests in a partially centered manner against the further compression spring 48, as explained above. In its initial position shown in FIG. 2, the main spool 32 covers a further fluid chamber 66, which, as in the fluid chamber 52, is pressurized by the spool end or base end 24 of the boom cylinder unit 10. The fluid routing is shown in the hydraulic circuit diagram in FIG. 1. Furthermore, the main spool 32 has, opposite from the accumulator port S, a bore 68, which transitions at the edge into control edges 70. Control edges 70 are designed as a restriction and are part of a ledge. The ledge transitions into the larger outer diameter of the outer circumference of the main spool 32 and, opposite the control edges 70, into a smaller diameter formed by the bore 68 in the main spool 32. Viewed in the direction of FIG. 2, the main spool 32 covers a vertically extending fluid duct 72, which opens at one end at the tank return line T and is closed by a plug 74 at the other, opposite end as the additional return port T' in the valve housing 30. The plug is removed to establish the tank return connection at start-up. Furthermore, the actuating solenoid device 38 of the pilot valve 36 extends through the valve housing 30 from above, together with the associated fluid duct 72. The solenoid free actuating end face is inserted in the valve housing 30, for instance screwed in or secured to the top of the valve housing 30 by a flange plate. On the upper end of the pilot valve 36, there is a connector 76 for connecting an electrical connection to the actuating solenoid device 38 of the pilot valve 36. The solenoid device is energized by an operator of the mobile machine to establish the mentioned damping connection, which actuates the pilot valve 36.

In a further sequence, the main spool 32 having a stepped diameter reduction passes through a further fluid chamber 78, which is connected to the rod end or rod chamber 28 of the boom cylinder unit 10 in a fluid-conveying manner. On its bottom end, the pilot valve 36 opens into a connecting channel 80 that, according to the illustration of FIG. 2, is traversed by the main spool 32 from the further or pilot restriction 46. Restriction 46 is arranged between a transverse channel and a longitudinal channel in the main spool 32. The longitudinal channel opens into a further control chamber 84, such that, when a corresponding pressure builds up in the further control chamber 84, the main spool 32 moves from its initial position to the left, as viewed in the direction of FIG. 2, against the action of the further compression spring 48. During the displacement motion of the main spool 32 in this left direction, it travels to the respective positions as shown in FIGS. 3-5, which are explained in more detail below.

The operator decides when to engage the ride control system. This occurs when the operator energizes the main ride control solenoid 38 of the pilot valve 36. When this happens, pilot pressure is applied to the right of the main spool 32 in the chamber 84 via the orifice 46.

Figure 3:
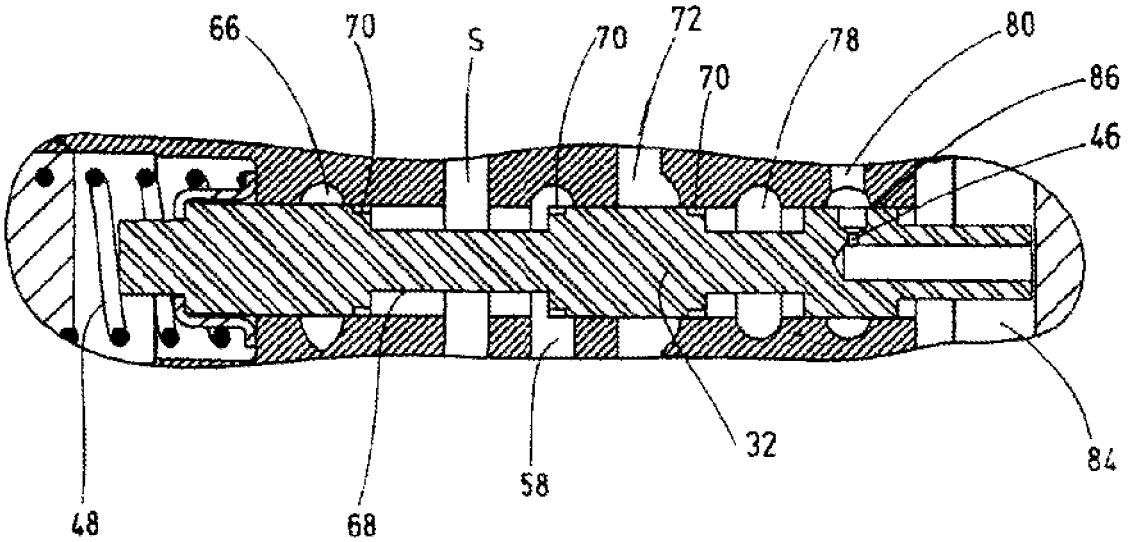
FIGS. 3-5 are partial side views in section of the ride control valve according to FIG. 2 showing the main spool in different displacement positions.

As shown in FIG. 3, the orifice 46 restricts the amount of flow that can enter the control chamber 84. All the flow through the pilot valve 36 must pass through the orifice 46 because of the spool overlap condition 86. This overlap condition causes the main spool 32 to slowly shift to the left. As the main spool 32 slowly shifts to the left, the left side notch 70 opens and the fluid flows into chamber 66 regulating the flow from the base end 24 of the cylinder unit 10 to the accumulator 14. In this way, the pressures are balanced in a controlled manner that can be adapted to the customer's needs.

Figure 4:
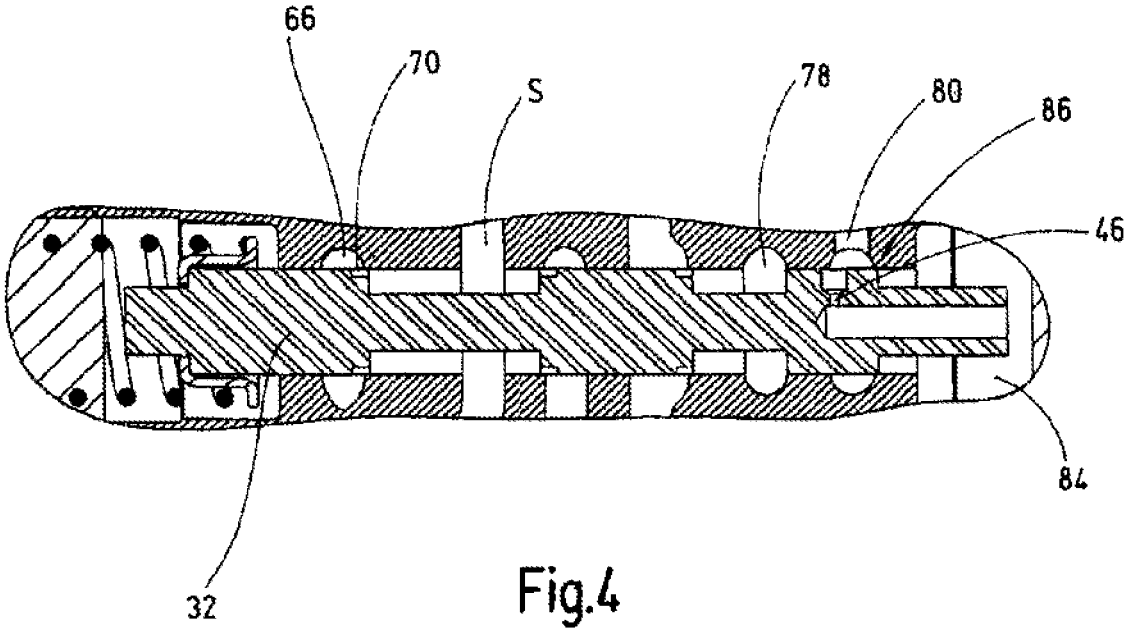
Figure 5:
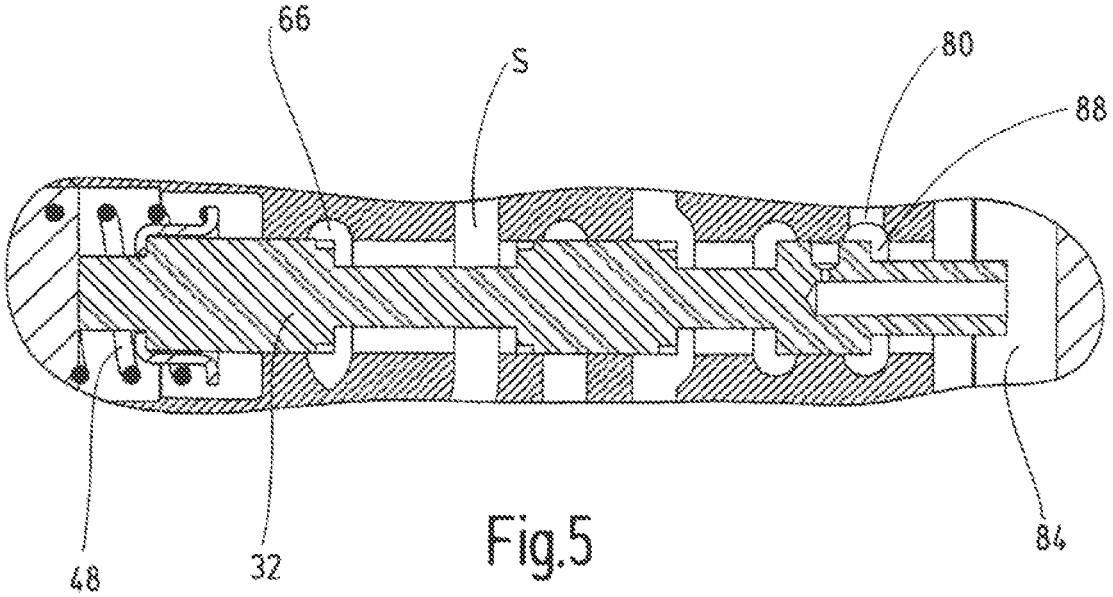

As shown in FIG. 4, when the main spool 32 continues to shift to the left the spool overlap condition 86 becomes zero. When this happens, the spool orifice 46 is bypassed, and the pressure regulated by the pilot valve 36 is directly applied to the chamber 84. When this happens, the spool 32 rapidly moves further to the left and quickly shifts to the wide-open position. This movement also ends any soft-shift regulation from the left side notch 70 in the main spool 32.

As shown in FIG. 5, when the main spool 32 is in the fully extended position, there is a new connection 88 that is open between the connection line 80 controlled by the pilot valve 36 and the hydraulic chamber 84. This opening provides a very easy path to go from fluid line 80 to chamber 84 with very little restriction. When the main spool 32 is in the fully extended position it also makes for very little resistance between the base end 24 of the cylinder unit 10 and the accumulator 14. This connection allows all pressure loads to pass through these points with very little restriction, resulting in a softer ride for the operator of the mobile machine, and a full dampening effect was reached for the hydraulic boom unit 10.

Figure 6:
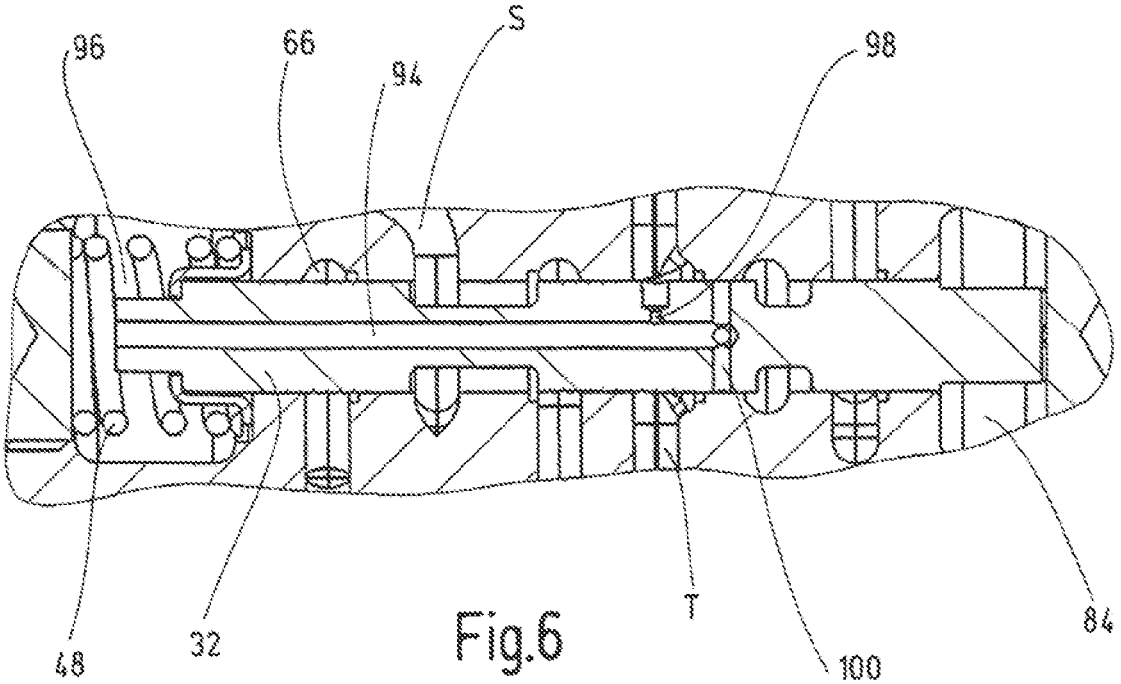
FIG. 6 is a partial side view in section of a ride control valve with a modified main spool according to a second exemplary embodiment of the invention.

The solution according to FIG. 6 shows an alternative embodiment to the valve solutions above. In this solution, the main spool 32 has a longitudinal channel 94, one end of which opens into a further control chamber 96 with partial spring centering. The other free end region of channel 94 opens into a further, fourth restriction 98. After this restriction 98 is passed, with increasing overlap, a subsequent transverse connection 100 having a comparatively larger cross-sectional area opens into the tank return line T.

This alternate embodiment of the configuration according to the invention shows how the same soft-shift effect can be obtained on the opposite end of the main spool 32. As the pilot pressure is increased in the chamber 84, the main spool 32 is moved towards the open position. However, this motion is resisted because of the fluid trapped in the spring chamber 96. The fluid in the chamber 96 has to pass through the channel 94 and then across the orifice 98 much in the same way as it does across the orifice 46 according to the first solution described above. The fluid slowly passes through the orifice 98 and is drained to the tank line T. This slow drainage allows the main spool 32 to slowly move towards the open position until the point in time the channel 100 opens into the tank line chamber having the tank connection T. At this time, the fluid can bypass the orifice 98 and will immediately enter the chamber T. This bypassing allows the main spool 32 to quickly move into the open position to guarantee the full dampening effect for the hydraulic boom cylinder unit 10 by the accumulator or dampening device 14.

Summarized, this invention can be used to let the main spool 32 slowly shift to a narrowed open position in the first part of the spool stroke and then to quickly shift to the completely open position once the main spool 32 has reached a certain position. In this way, the pressure can be slowly balanced between the base end 24 of the cylinder unit 10 and the accumulator 14 via at least one notch 70 in the spool stroke for a certain period of time and then be fully opened to allow for maximum flow between the base end 24 of the cylinder unit 10 and the accumulator 14, which significantly reduces vibrations and increases the operator's comfort.

While various embodiments have been chosen to illustrate the invention, it will be understood by those skilled in the art that various changes and modifications can be made therein without departing from the scope of the invention as defined in the claims.

The invention claimed is:

1. A ride control valve, comprising:

a valve housing having a pressure supply port, a tank line port, an accumulator port and a boom cylinder unit port;

a main spool longitudinally displaceable in the valve housing, controllable by an operator and initially interconnecting the accumulator port and the boom cylinder unit port in fluid communication from a closed fluid connection via a restricted fluid connection and then to a fully opened fluid connection or disconnecting the interconnecting of the accumulator port and the boom cylinder unit port from fluid communication from the fully opened fluid connection and then to the closed fluid connection via the restricted fluid connection, the main spool including a longitudinal channel having a first axial end opening into a control chamber having a spring therein biasing the main spool to an initial center position thereof and a second axial end opening into a restriction and including a transverse connection with a larger cross-sectional area than the restriction located on a side of the restriction remote from the first axial end opening into the tank line port; and a balance spool longitudinally displaceable in the valve housing, continuously balancing fluid pressure between the accumulator port and the boom cylinder unit port.

2. A ride control valve according to claim 1 wherein the balance spool is accommodated in a balance spool chamber in the valve housing, is spring biased in an initial center position thereof, and is subjected to fluid pressure from the accumulator port at a first axial end of the balance spool and subjected to fluid pressure from the boom cylinder unit port at a second axial end of the balance spool;

whereby to achieve a continuous pressure balance between the accumulator port and the boom cylinder unit port, the balance spool is movable in a first axial direction connecting the accumulator port and the pressure supply port in fluid communication when pressure at the boom cylinder unit port is greater than pressure at the accumulator port, and the balance spool is movable in an opposite second axial direction connecting the accumulator port and the tank line port in fluid communication when the pressure at the accumulator port is greater than the pressure at the boom cylinder unit port.

3. A ride control valve according to claim 1 wherein the main spool is accommodated in a main spool chamber in the valve housing and is movable by a pilot valve actuatable by the operator and supplying fluid pressure against a spring biasing force on the main spool to a position establishing the fully opened position providing fluid communication between the accumulator port and the boom cylinder unit port.

4. A ride control valve according to claim 3 wherein the main spool comprises a pilot restriction on an outer circumference thereof connecting pilot pressure from the pilot valve into a control chamber in the main spool chamber receiving the main spool, the main spool being movable by the pilot pressure toward the fully opened fluid connection from the initial center position thereof when the spring biasing force is exceeded, with a fluid connection between the pilot valve and the control chamber being increasingly interrupted by the pilot restriction.

5. A ride control valve according to claim 4 wherein the pilot restriction comprises a transverse drilled hole in the main spool extending into a longitudinal drilled hole in the main spool opening into the control chamber.

6. A ride control valve according to claim 3 wherein the pilot valve is inserted in the valve housing and is actuatable by an actuating solenoid, energization of the actuating solenoid being operator-controlled.

7. A ride control valve according to claim 3 wherein the pilot control valve is connected in fluid communication with a pilot pressure control port independent of the pressure supply port, pressure at the pilot pressure control port being lower than pressure at the pressure supply port.

8. A ride control valve according to claim 1 wherein a cross section of the main spool is reduced in an area of the boom cylinder unit port in a direction of the accumulator port forming a restriction and establishing a restricted fluid connection between the accumulator port and the boom cylinder unit port.

9. A ride control device, comprising:

a hydraulic boom cylinder unit;

a hydraulic accumulator;

a ride control valve having a main spool and a balance spool in a valve housing connecting the hydraulic boom cylinder unit and the hydraulic accumulator, the valve housing including a pressure supply port connected to a pump in fluid communication, a tank line port connected in fluid communication to a tank, an accumulator port connected in fluid communication with the hydraulic accumulator, and a boom cylinder unit port connected in fluid communication with the hydraulic boom cylinder unit; and a pilot valve connected in the valve housing at least partially controlling movement of the main spool in the valve housing, the main spool being longitudinally displaceable in the valve housing, being controllable by an operator by the pilot valve and initially interconnecting the accumulator port and the boom cylinder unit port in fluid communication from a closed fluid connection via a restricted fluid connection and then to a fully opened fluid connection or disconnecting the interconnecting of the accumulator port and the boom cylinder unit port from fluid communication from the fully opened fluid connection and then to the closed fluid connection via the restricted fluid connection, the balance spool being longitudinally displaceable in the valve housing and continuously balancing fluid pressure between the accumulator port and the boom cylinder unit port, the main spool including a longitudinal channel having a first axial end opening into a control chamber having a spring therein biasing the main spool to an initial center position thereof and a second axial end opening into a restriction and including a transverse connection with a larger cross-sectional area than the restriction located on a side of the restriction remote from the first axial end opening into the tank line port.

10. A ride control device according to claim 9 wherein the balance spool is accommodated in a balance spool chamber in the valve housing is spring biased in an initial center position thereof, and is subjected to fluid pressure from the accumulator port at a first axial end of the balance spool and subjected to fluid pressure from the boom cylinder unit port at a second axial end of the balance spool;

whereby to achieve a continuous pressure balance between the accumulator port and the boom cylinder unit port, the balance spool is movable in a first axial direction connecting the accumulator port and the pressure supply port in fluid communication when pressure at the boom cylinder unit port is greater than pressure at the accumulator port, and the balance spool is movable in an opposite second axial direction connecting the accumulator port and the tank line port in fluid communication when the pressure at the accumulator port is greater than the pressure at the boom cylinder unit port.

11. A ride control device according to claim 9 wherein the main spool is accommodated in a main spool chamber the valve housing and is movable by the pilot valve actuatable by the operator and supplying fluid pressure against a spring biasing force on the main spool to a position establishing the fully opened position providing fluid communication between the accumulator port and the boom cylinder unit port.

12. A ride control device according to claim 11 wherein the main spool comprises a pilot restriction on an outer circumference thereof connecting pilot pressure from the pilot valve into a control chamber in the main spool chamber receiving the main spool, the main spool being movable by the pilot pressure toward the fully opened fluid connection from the initial center position thereof when the spring biasing force is exceeded, with a fluid connection between the pilot valve and the control chamber being increasingly interrupted by the pilot restriction.

13. A ride control device according to claim 12 wherein the pilot restriction comprises a transverse drilled hole in the main spool extending into a longitudinal drilled hole in the main spool opening into the control chamber.

14. A ride control device according to claim 11 wherein the pilot valve is inserted in the valve housing and is actuatable by an actuating solenoid, energization of the actuating solenoid being operator-controlled.

15. A ride control device according to claim 11 wherein the pilot control valve is connected in fluid communication with a pilot pressure control port independent of the pressure supply port, pressure at the pilot pressure control port being lower than pressure at the pressure supply port.

16. A ride control device according to claim 9 wherein a cross section of the main spool is reduced in an area of the boom cylinder unit port in a direction of the accumulator port forming a restriction and establishing a restricted fluid connection between the accumulator port and the boom cylinder unit port.

* * * * *